US008341781B1

(12) United States Patent
Bleser

(10) Patent No.: US 8,341,781 B1
(45) Date of Patent: Jan. 1, 2013

(54) MULTIPLE USE CHILD CONTAINMENT ASSEMBLY

(76) Inventor: Sandra Bleser, Key Largo, FL (US)

( * ) Notice: Subject to any disclaimer, the term of this patent is extended or adjusted under 35 U.S.C. 154(b) by 856 days.

(21) Appl. No.: 12/231,895

(22) Filed: Sep. 5, 2008

Related U.S. Application Data

(60) Provisional application No. 60/993,097, filed on Sep. 7, 2007.

(51) Int. Cl.
*A47D 9/00* (2006.01)

(52) U.S. Cl. ..... 5/655; 5/99.1

(58) Field of Classification Search ..... 5/655, 93.1, 5/97, 99.1
See application file for complete search history.

(56) References Cited

U.S. PATENT DOCUMENTS

| | | | | |
|---|---|---|---|---|
| 1,760,301 | A | 5/1930 | Dougherty | |
| 2,561,016 | A | 7/1951 | Ford et al. | |
| 2,649,533 | A | 8/1953 | Meredith et al. | |
| 2,677,834 | A | 5/1954 | Moynihan | |
| 2,784,420 | A | 3/1957 | Moltane | |
| 3,430,271 | A | 3/1969 | Junod-Deile | |
| 3,438,069 | A | 4/1969 | Long | |
| 3,763,506 | A | 10/1973 | Szego | |
| D229,799 | S | 1/1974 | Suzuki | |
| 3,833,947 | A | 9/1974 | Sorensen | |
| 4,003,098 | A | 1/1977 | Fink | |
| 4,008,497 | A | 2/1977 | Badon | |
| 4,073,017 | A | 2/1978 | Stevens | |
| 4,094,357 | A | 6/1978 | Sgroi | |
| 4,653,131 | A | 3/1987 | Diehl | |
| 4,790,340 | A | 12/1988 | Mahoney | |
| 4,815,153 | A * | 3/1989 | Bleser et al. | 5/98.1 |
| 5,018,226 | A * | 5/1991 | Davies et al. | 5/81.1 R |
| D318,895 | S | 8/1991 | Kuan | |
| D344,642 | S | 3/1994 | Artz | |

(Continued)

FOREIGN PATENT DOCUMENTS

DE 2347526 4/1975

OTHER PUBLICATIONS

Aircrib, The Aircrib, www.aircrib.com.

(Continued)

*Primary Examiner* — Fredrick Conley
(74) *Attorney, Agent, or Firm* — Malloy & Malloy, P.L.

(57) ABSTRACT

An inflatable child containment assembly generally in the form of a play pen type structure capable of multiple uses including a contained play area, a resting or sleeping space, a splash pool, a wash basin, and a support platform for changing a child. A wall assembly has sufficient structural integrity when inflated to assume either a first operative or upright position or a second operative, inverted position, depending on the intended use. A plurality of interconnected wall sections define the wall assembly and are collectively disposed in a closed, continuous configuration to form an interior child containment area having a closure assembly covering one end thereof. An inflatable base may serve as a cushion when removably disposed within the containment area. When in the deflated and collapsed orientation, the containment assembly may be easily carried by an individual utilizing an appropriate pouch or bag.

20 Claims, 11 Drawing Sheets

U.S. PATENT DOCUMENTS

| | | | | |
|---|---|---|---|---|
| 5,291,623 | A | | 3/1994 | Artz |
| 5,462,505 | A | | 10/1995 | Blair et al. |
| 5,575,738 | A | | 11/1996 | Millington et al. |
| D411,686 | S | | 6/1999 | Garcia |
| 6,058,528 | A | * | 5/2000 | Yang ..... 5/93.1 |
| 6,119,288 | A | | 9/2000 | Hendrickson |
| 6,354,004 | B1 | | 3/2002 | Worsham |
| 6,357,462 | B1 | | 3/2002 | Laosunthara et al. |
| 6,425,150 | B1 | | 7/2002 | Cheng |

OTHER PUBLICATIONS

BTVco, Aircrib—inflatable travel crib, www.btvco.com.

Cabela'S, AirCrib by BTVco, www.cabelas.com.

Shoppingatnet, Intex Soft-Sides My First Gym, shoppingatnet.stores.yahoo.net.

Sevylor, Swiming Pool Products, www.sevylor.com.

* cited by examiner

MULTIPLE USE CHILD CONTAINMENT ASSEMBLY

CLAIM OF PRIORITY

The present application is based on and a claim to priority is made under 35 U.S.C. Section 119(e) to a provisional patent application that is in the U.S. Patent and Trademark Office, namely, that having Ser. No. 60/993,097 and a filing date of Sep. 7, 2007, and which is incorporated herein by reference.

BACKGROUND OF THE INVENTION

1. Field of the Invention

This invention is directed to a child containment assembly having an inflatable construction capable of being selectively disposable into an expanded or collapsed position for use or storage, respectively. A wall assembly and additional operative components associated therewith are cooperatively structured to allow for multiple uses including, but not limited to, an indoor/outdoor contained play area, a resting or sleeping area, a splash pool or wash basin, as well as a support platform usable as a changing or dressing area for a child. Dependent on an intended use of the containment assembly, it is disposable in either a first or second operative position.

2. Description of the Related Art

In the past, there have been numerous types of inflatable objects, such as balloons, simulated furniture, sporting equipment, and flotation devices. More recently, inflatable structures and features have been incorporated into play pens for children. However, current inflatable play pen structures have limited utility in that they serve the narrow purpose of providing a confining area for a child to play or possibly sleep. It would therefore be beneficial to provide an inflatable child containment assembly that is structured for additional uses. For instance, it would be a benefit for such a containment assembly to readily provide for a structurally sound changing area, which would be extremely convenient given that makeshift changing areas are often unsafe or uncomfortable. It would also be advantageous for an inflatable child containment assembly to be structured for use as a splash pool, which would eliminate the need for a consumer to separately purchase both a play pen and a splash pool, while providing the added convenience of portability. Likewise, it would be beneficial for such a child containment assembly to be further structured for use as a wash basin.

It would also be an advantage for such an assembly to include structural features that provide for additional child comfort. For example, it would be an advantage to provide an inflatable structure for supporting the child's head in any one of the aforementioned uses. It would be a further advantage to provide a cushioning structure that supports the child's entire body and that also serves to keep the child dry. It would also be beneficial to control the temperature of the assembly for additional child comfort.

It would be a further benefit to include various safety features in such an inflatable child containment assembly. For example, it would be advantageous for such an assembly to maintain sufficient structural integrity even when partially deflated so as to avoid collapsing onto the children contained therein.

SUMMARY OF THE INVENTION

The present invention is intended to present a solution to the above and/or other needs in this field of art, and as such, is directed to a containment assembly for at least one child or infant, which is structured for multiple uses depending, at least in part, whether the containment assembly is disposed in a first operative position or a second operative position. More specifically, the various components of the containment assembly are cooperatively structured and collectively assembled to define what may generally be described as a play pen type of structure but which has significantly greater versatility in its use, assembly, storage and transportation.

More specifically, the child containment assembly of the present invention comprises a wall assembly having an inflatable structure. When inflated and disposed into either of the operative positions, the containment assembly comprises a continuous, closed configuration disposed in surrounding relation to an interior containment area in which one or more children and/or infants may be placed. Being inflatable, the wall assembly is selectively disposable into an expanded orientation for use or a collapsed orientation for storage and transport.

A closure assembly, preferably in the form of a strong yet lightweight, flexible material panel or sheet is connected in covering relation to one originally open end of the wall assembly and thereby serves to close one end of the interior containment area. As such, when the closure assembly is disposed in an upright or first operative position the closure assembly is disposed to serve as a "floor" of the containment area. Further, the closure assembly is continuously connected about its periphery to the border or boundaries of the corresponding originally open end of the wall assembly, which it covers and closes. The opposite end of the wall assembly is left open and thereby defines an access opening. The access opening is disposed, dimensioned and configured to facilitate passage there through of the one or more children, infants, etc. into and out of the containment area.

As set forth above, one of the multiple uses of the child containment assembly of the present invention is a minimum depth "splash pool". For such use, water is placed in the containment area in a sufficient quantity to only cover the interior surface of the closure assembly, but in an insufficient quantity to endanger one or more children located within the containment area. By way of example, the aforementioned splash pool can be created by placing a sufficient quantity of water to achieve an approximate one or two inch depth above the interior surface of the closure assembly. This is generally considered to not represent a hazard to a child provided the child is of a sufficient age to control its body such as by being able to walk, crawl, sit-up, etc. However, in order to use the child containment assembly as a splash pool, the interconnection between the periphery of the closure assembly and the corresponding border of the end of the wall assembly is structured to be substantially water or fluid tight. Such a fluid tight connection or seal structure prevents inadvertent leakage of the water through the junction of the closure assembly and the corresponding end of the wall assembly. Similarly, another one of the multiple uses of the child containment assembly of the present invention is a wash basin wherein water is placed in the containment area in a sufficient quantity to safely bathe one or more children. The assembly can also include a marker line or other type of visual indicator which provides a reading as to the maximum "safe" quantity of water which should be maintained within the containment area.

Other structural features of at least one preferred embodiment of the child containment assembly includes a base, itself being of an inflatable construction having a sufficient dimension and overall structure to serve as a cushion when positioned, as intended within the containment area. More specifically, the base or cushion has a peripheral dimension which corresponds to the interior surface of the containment area, which is immediately adjacent to the interior surface of the closure assembly. As such, when operatively disposed, the base is disposed in overlying, covering relation to the closure assembly and is removably maintained in such a position due to the frictional engagement between the surrounding, outer peripheral surface of the base and the correspondingly disposed interior surface of the wall assembly immediately adjacent to the closure assembly. Additional structural features of the base include a thickness or transverse dimension as well as a fluid capacity which is sufficient to facilitate the base serving as the aforementioned cushion, thereby providing comfort and safety to one or more children maintained within the containment area.

The top and/or bottom surfaces of the base can be further structured to define a relief configuration that permits air to circulate between the supported child and at least a portion of the base that faces and supports the child, thus providing a degree of ventilation. The surface relief configuration can also serve as a reservoir for liquid, such as in the case of a drink that has been spilled onto the base by the child. Each of these aspects of the surface relief structure serves to keep the child dry.

To further facilitate the comfort of the resting or sleeping child, a cover may be used to overlie the exposed surface of the base. In at least one embodiment, the cover comprises a soft, lightweight material of construction such as, but not limited to, cotton, which may also be washable. Additionally, the cover may comprise a fluid permeable construction such that the cover and the base can be cooperatively structured to allow fluids to pass through the cover and into the lower areas of the surface relief configuration. In the event that any residual amount of liquid has been retained by the cover, air circulation facilitates drying of the cover.

As set forth above, the multiple use capabilities of the child containment assembly of the present invention is facilitated, at least in part, by the wall assembly having a sufficient structural integrity when inflated into an expanded orientation to readily assume either a first operative position or a second operative position. Moreover, the first operative position may be generally described and defined as an upright orientation, wherein the outer surface of the closure assembly is disposed in confronting engagement with or otherwise adjacent to a supporting surface of the wall assembly. As such, the first operative position of the containment assembly and wall assembly is such that the access opening defines an upper or top portion of the wall assembly. Moreover when in the first operative position, one or more children are lowered through the access opening into the interior containment area so as to be supported on the interior surface of the closure assembly or alternatively on the cushion defined by the inflated base.

In contrast, the structural integrity of the wall assembly is such that it can be selectively disposed in a second operative position which may also be accurately described as an inverted position relative to the first operative position. In the inverted, second operative position, the access opening is disposed in adjacent relation to the supporting surface of the child containment assembly, wherein the closure assembly is disposed in an outer, upper, exposed position. Therefore, when the wall assembly is in the second, inverted position, the exterior surface of the closure assembly is exposed and the closure assembly itself defines the upper end or portion of the wall assembly. Moreover, the closure assembly, in at least one preferred embodiment of the present invention is formed of a strong, lightweight flexible material panel or sheet of sufficient strength to define a support platform for an infant or small child. As such, this support platform may serve as an area for changing or dressing the infant or child.

Yet another preferred embodiment of the present invention is directed to a "kit assembly" comprising a plurality of operative and structural components as generally described above, at least most of which include an inflatable structure capable of being inflated into an expanded orientation or deflated and thereby reduced to a collapsed orientation of significantly reduced volume. Such a kit assembly would also include a carrying pouch, bag or other appropriate container sufficiently dimensioned and structured to store each of the operative components of the wall assembly, base, etc. therein when deflated into the collapsed orientation as set forth above. The child containment assembly may also include a head support that is structured to be inflated and positioned to support a child's head, and which can be utilized for a variety of situations as described herein.

Other operative components of such a kit assembly may include the pouch or carrying container having an arm or shoulder sling so as to facilitate mounting and support on an individual's shoulder or other appropriate portion of the carrier's body. Also, the aforementioned kit assembly may include an air or fluid source, such as a manual or automatically driven air pump of sufficient size and fluid capacity to efficiently fill the wall assembly and the base. As such, the air pump or other appropriate air or fluid generating assembly should also be capable of being carried in the aforementioned bag or like container.

The present invention additionally includes a "two step" method for assembling and disassembling the child containment assembly wherein the proper operative engagement between the base and the wall assembly is contingent upon the order in which the aforementioned components are assembled as well as the order in which the wall assembly is inflated. Accordingly, the method begins with positioning the base in an operative position on the interior of the wall assembly. Next, the wall assembly is inflated, which temporarily locks the base into its operative position. The base may be inflated before or after being placed into its operative position, so long as the base is placed into its operative position before inflation of the wall assembly. However, in one embodiment, it is preferable to inflate the base before inflating the wall assembly. Once the base is properly disposed in the operative position, the base can only be removed by reversing the inflation process, namely, the wall assembly must be substantially deflated before the base can be disengaged from the operative position.

Yet another operative feature of the child containment assembly is a temperature control capability which can be utilized to heat or cool at least a portion of the child containment assembly to suit the child's comfort. In one embodiment, the temperature of the base is controlled by the temperature of the air or other type of fluid that is utilized to inflate the base, including but not limited to liquids, such as water. Specifically, the base is disposed in circulating fluid communication with a regulator, wherein the regulator is structured to maintain a predetermined temperature of the air or fluid. The temperature of other components, such as the wall assembly or the head support, may also be regulated in a similar manner.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As represented in the accompanying drawings, the present invention is directed to a child containment assembly, generally indicated as 10. Moreover, the various structural and operative features of the containment assembly 10 facilitate it being capable of multiple uses, each of which involve the containment of one or more infants or children. The specific use of the containment assembly 10 is at least partially dependent on the wall assembly, generally indicated as 12, being in an upright or first operative position or in an inverted, second operative position.

Figure 1:
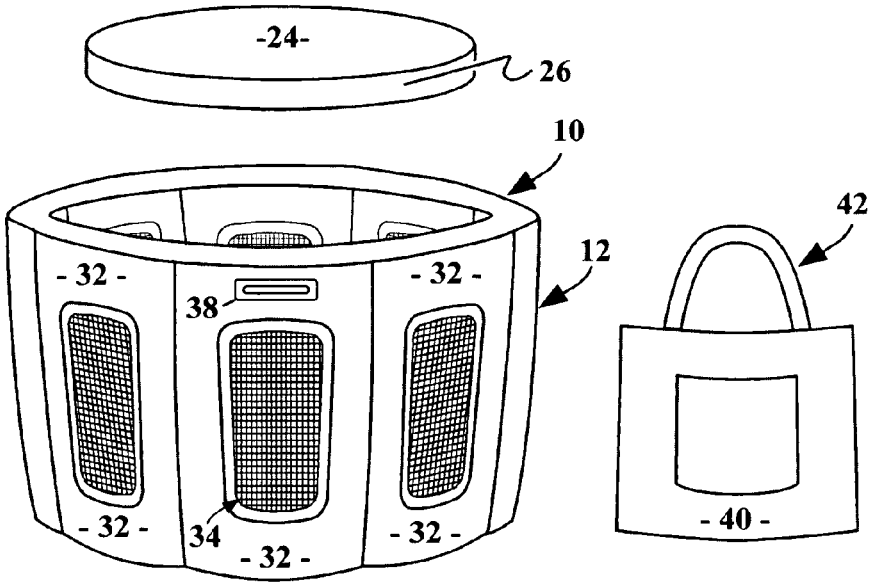
FIG. 1 is a perspective view of a child containment assembly of the present invention and other operative components associated therewith, disposed in an upright or first operative position.
Figure 2:
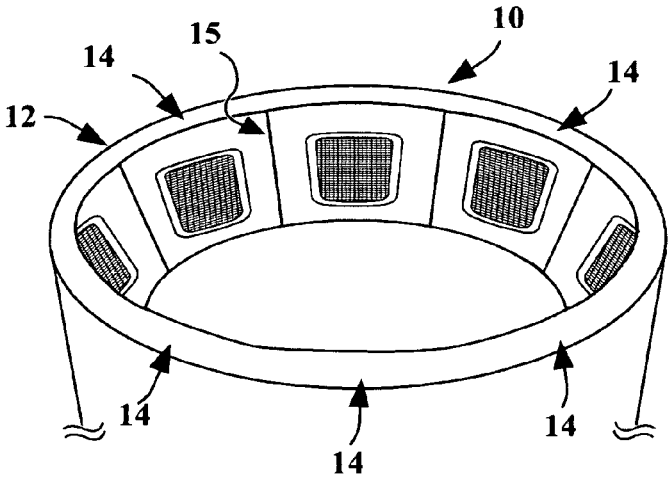
FIG. 2 is an interior perspective view of the wall assembly of the child containment assembly in the first operative position so as to serve as a resting or sleeping area.
Figure 3:
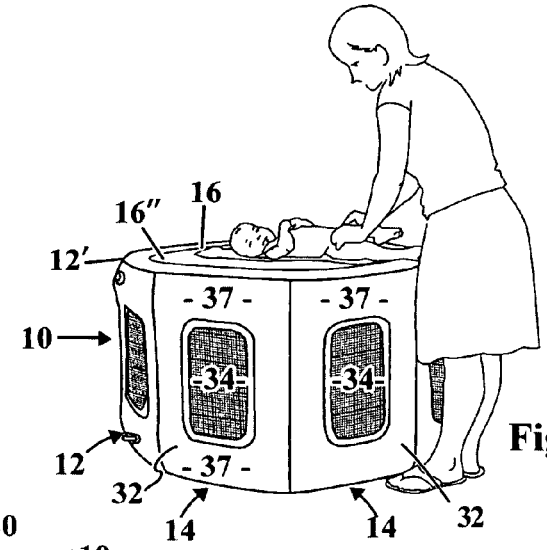
FIG. 3 is a perspective view of the child containment assembly and associated wall assembly in an inverted or second operative position.
Figure 4:
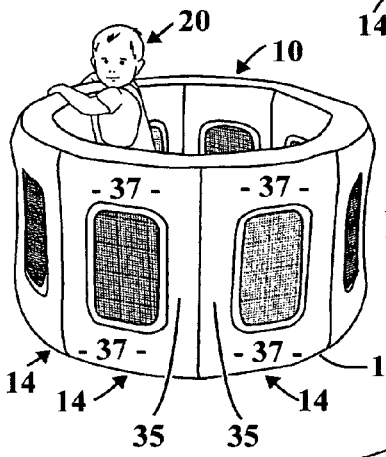
FIG. 4 is a perspective view of the wall assembly in the first operative position, wherein the child containment assembly serves as a play pen type of structure or "play yard".
Figure 5:
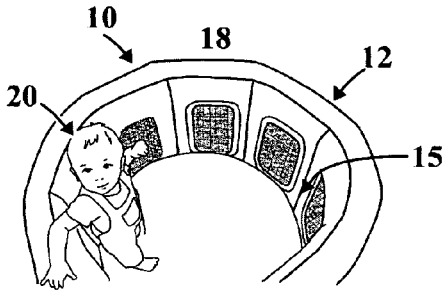
FIG. 5 is an interior perspective view similar to the embodiment of FIG. 4 wherein the child containment assembly is sufficiently dimensioned and structured to maintain a plurality of children and/or infants therein.
Figure 6:
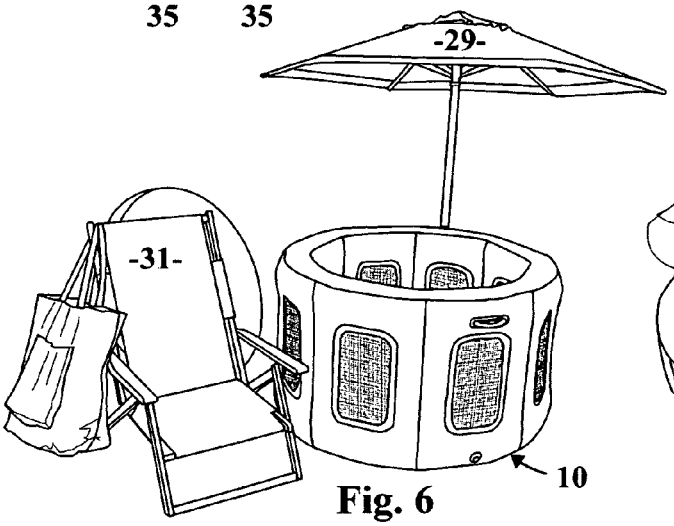
FIG. 6 is a child containment assembly of the embodiment of FIG. 1 in an outdoor environment serving as a "play yard" structure in an outdoor environment.
Figure 7:
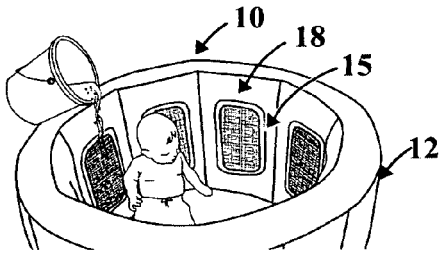
FIG. 7 is an interior perspective view of the child containment assembly of the embodiment of FIG. 1 serving as a splash pool wherein water is added to the interior containment area.
Figure 14:
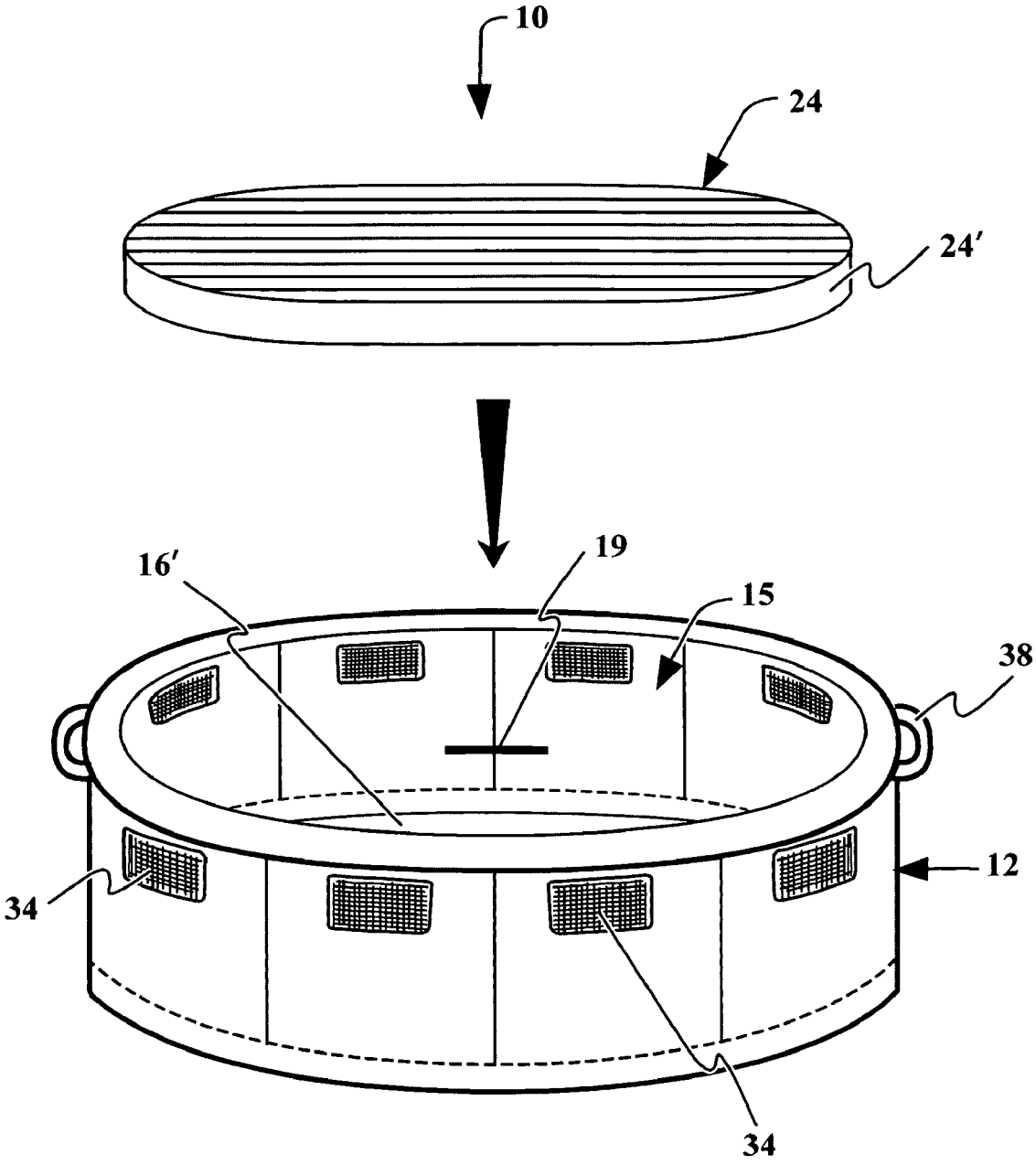
FIG. 14 is a perspective view of a child containment assembly of the present invention having an oblong configuration.

By way of example, the various uses for which the containment assembly 10 include a contained play area or "play yard" as demonstrated in FIGS. 4, 5 and 6; a confined resting or sleeping area, as demonstrated in FIG. 2; a changing or servicing area and support platform as demonstrated in FIG. 3; a "splash pool" as represented in FIG. 7; and/or a wash basin as represented in FIG. 14. Moreover, an upright or operative first position of the containment assembly 10 and wall assembly 12 is represented in FIGS. 1, 2, 4-7, and 14. In contrast, an inverted or second operative position is represented in FIG. 3. As such, each of the uses as well as the disposition, orientation and structure of the various operative components of the containment assembly 10 will be described in greater detail hereinafter with specific reference to the noted figures and the intended usage of the containment assembly relative to the first and second operative positions in which the containment assembly 10 is disposed.

Accordingly, the containment assembly 10 includes the wall assembly 12 formed of an inflated construction such that the wall assembly 12 is capable of being inflated and therefore disposed in an expanded orientation or alternatively deflated and disposed in a collapsed, stored position as referred to and described hereinafter with reference to FIG. 2A. The wall assembly 12 is formed of the aforementioned inflated construction and comprises a plurality of interconnected wall sections 14 which may vary in number depending upon the intended size of the containment assembly 10, but which collectively define a continuous, closed and substantially annular configuration as represented throughout the accompanying figures.

Further, each of the plurality of wall sections 14 are preferably interconnected in a fixed manner and in fluid communication with one another and in successively adjacent relation so as to form the continuous, closed and substantially annular configuration. Accordingly, when inflated into the expanded orientation the plurality of wall sections 14 at least partially define the boundaries of an interior containment area 15 having at least one open end as at 18 which defines an access opening. As should be apparent, the access opening 18 is of sufficient dimension and configuration to allow the passage of one or more infants or children 20 therethrough for placement in or removal from the interior containment area 15. Also, the opposite end of the wall assembly 12 relative to the access opening 18 comprises a closure assembly generally indicated as 16. The closure assembly 16 overlies and covers the end 12' of the wall assembly 12 opposite to the access opening 18 and as such, serves to close that end of the interior containment area 15.

Moreover, the closure assembly 16, in at least one preferred embodiment of the present invention, comprises a lightweight relatively high strength flexible material panel or sheet-like structure having its periphery continuously connected in fluid sealing relation to corresponding peripheral portions of the end 12' of the wall assembly 12. Therefore, the connection between the closure assembly 16 and the end 12' of the wall assembly 12 is such as to form a water or fluid tight seal, which allows the maintenance of a certain quantity of water within the interior containment area 15 such that the containment assembly 10, as represented in FIG. 7, can serve as a "splash pool". Further with regard to FIG. 7, when used as a splash pool, the wall assembly 12 of the containment assembly 10 is disposed in the upright, first operative position as represented, such that the access opening 18 is readily exposed at the upper or top end of the wall assembly 12 as pictured.

When used as a splash pool, as represented in FIG. 7, the fluid tight or leak resistant interconnection between the closure assembly 16 and the end 12' of the wall assembly 12 allows a certain quantity of water to be maintained in substantially covering relation to the interior surface 16' of the closure assembly 16. As such, the closure assembly 16 serves as a "floor" when the wall assembly 12 is in the upright first operative position and the containment assembly 10 is used as the aforementioned splash pool.

Another preferred feature associated with the splash pool use is the provision of a marker line or some other type of visual indicator which provides a reading as to the maximum "safe" quantity of water which should be maintained within the containment area 15 so as to not present a danger to infants or small children. Such a quantity of water preferably, but not necessarily, provides a depth of approximately two inches (2") in covering relation above the interior surface 16' of the closure assembly 16. This marking or maximum fill line indicator structure serves to aide parents or caregivers as to the proper depth to maintain a safe environment when the containment assembly 10 is used as the aforementioned splash pool.

As set forth above, others of a plurality of possible uses, for which the containment assembly 10 is capable, are represented in FIGS. 2-6. With primary reference to FIG. 2, the containment assembly 10 may be used as a contained sleeping or resting area or space, wherein the wall section 12 is in the upright, first operative position also demonstrated in FIG. 1. In further facilitating use of the containment assembly 10 as a sleeping or resting area or space, this preferred embodiment of the present invention includes an inflatable base generally indicated as 24. The base 24 is correspondingly dimensioned and configured to substantially correspond to the interior surface portions of the wall assembly 12 immediately adjacent to the interior surface 16' of the closure assembly 16. When used, the base 24 is structured to be inflated and has a sufficient thickness or transverse dimension as well as a sufficient fluid capacity to serve as a cushion providing significant comfort to a child 20 when in a sleeping or resting mode as represented.

Further, a peripheral configuration and dimension of the base 24 is such as to establish a firm, snug, frictional engagement and therefore, locking but removable connection with the periphery or continuous side 24' of the base 24 and the corresponding interior surface portions of the wall assembly 12. When operatively positioned as represented in FIG. 2, the base 24 completely overlies and covers the interior surface 16' of the closure assembly 16 in order to avoid the hands, feet or other portions of an infant's body passing between the periphery 24' and the correspondingly disposed interior surface of the wall assembly 12.

Figure 8:
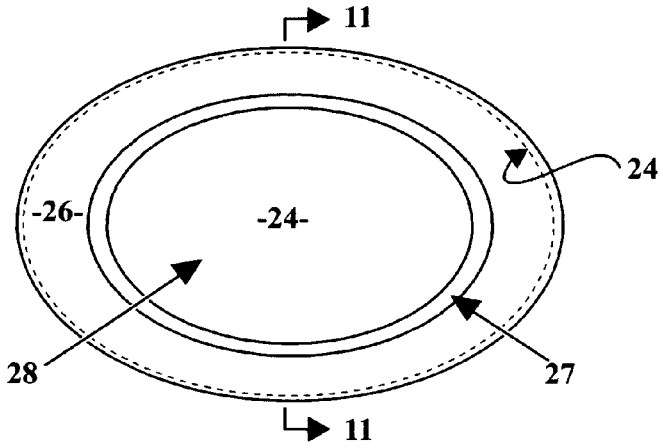
FIG. 8 is an elevation view of a cover disposed in a partially surrounding, fitted relation to a base.

To further facilitate the comfort of the resting or sleeping child, a cover 26, is used to overlie the exposed surface of the base 24 as represented in FIG. 2. In at least one embodiment, the cover 26 comprises a soft, lightweight material of construction such as, but not limited to, cotton. The cover 26 may also comprise a washable material of construction so that the cover 26 can be washed after use and then subsequently reused in a clean state. The cover 26 can also be structured to be removably disposed in at least a partially surrounding relation to the base 24. As depicted in FIG. 8, the cover 26 can also comprise an elastic portion 27 that defines an opening 28, such that when in a stretched orientation the elastic portion 27 permits insertion of the base 24 into the interior of the cover 26 through the opening 28. Once the base 24 is placed inside of the cover 26, the elastic portion 27 can return to a contracted orientation so as to maintain the cover 26 in a substantially fitted relation to the base 24. The cover 26 may also comprise a padded material for additional comfort.

Figure 9:
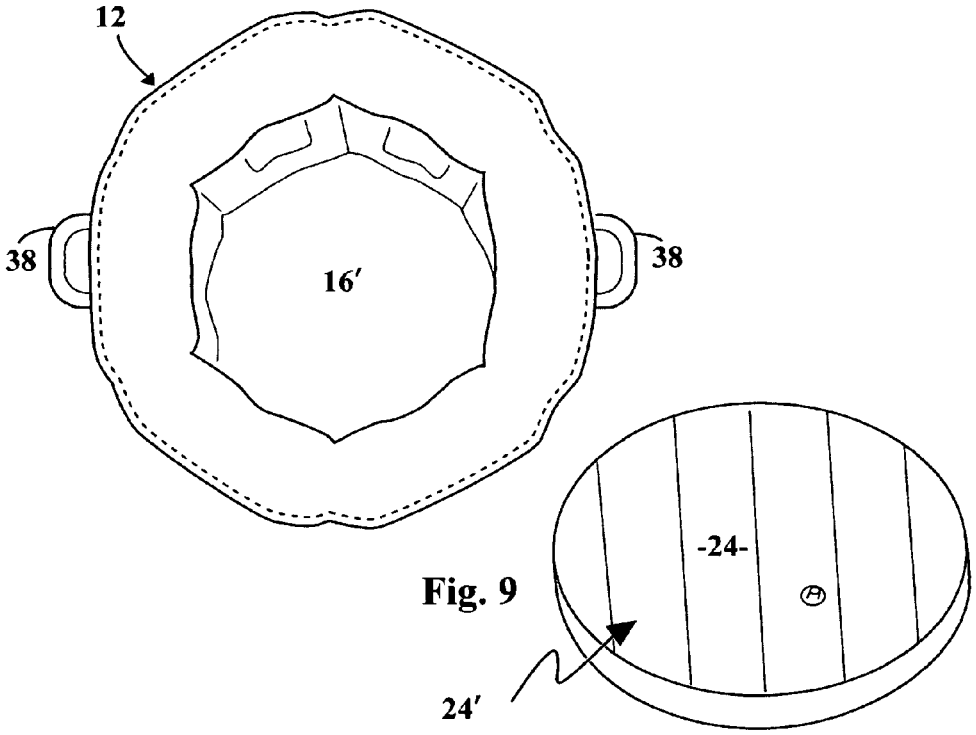
FIG. 9 is a perspective view of another embodiment of a child containment assembly.
Figure 10:
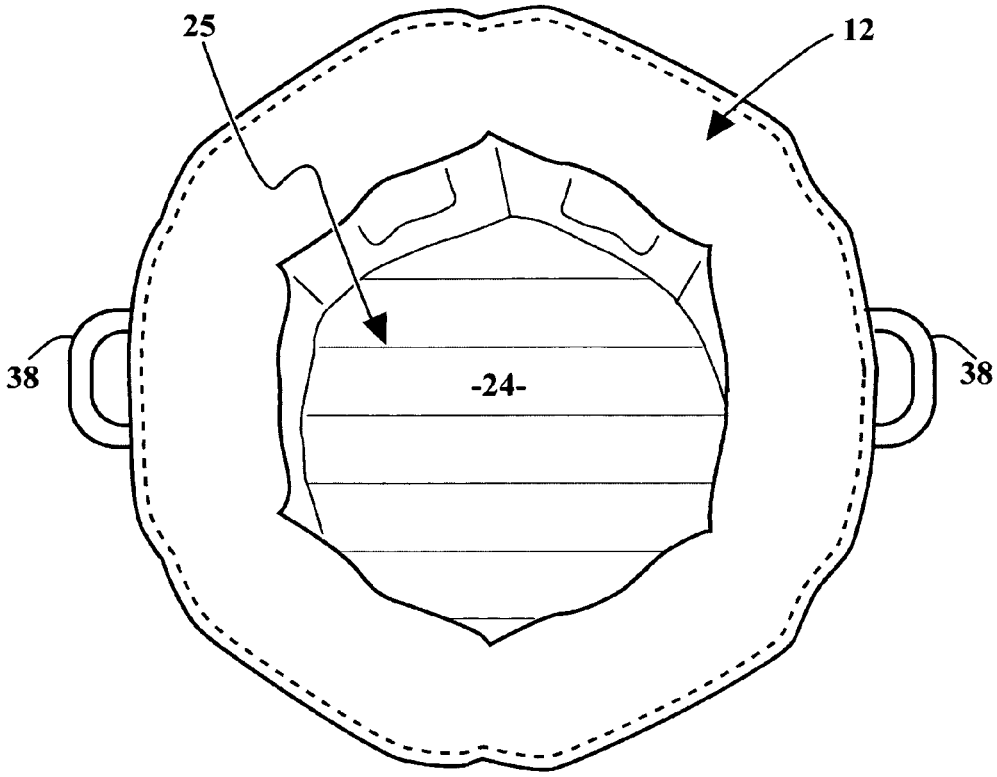
FIG. 10 is a perspective view of the embodiment of FIG. 9 wherein the base is disposed in an operative position.
Figure 11:
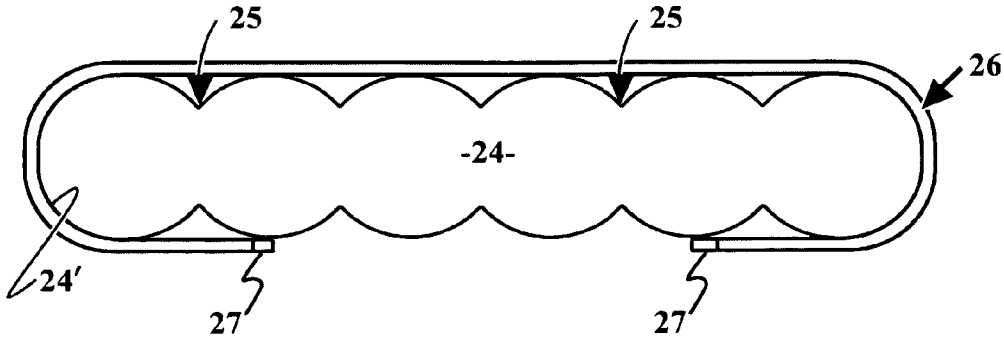
FIG. 11 is a section view of the embodiment of FIG. 8 along lines 11-11 thereof.

Turning to FIGS. 9-11, the top and/or bottom surfaces of the base 24 can be further structured to define a relief configuration structured to permit air to circulate between the supported child and at least a portion of the base 24 that faces and supports the child, thus providing a degree of ventilation. The relief configuration can also serve as a reservoir for liquid, such as in the case of a drink that has been spilled onto the base 24 by the child. Each of these aspects of the surface relief structure help to or serve to keep the child dry.

As illustrated in the particular embodiment of FIGS. 9-11, the surface relief configuration of the base 24 comprises a plurality of generally v-shaped channels 25 disposed in spaced relation to one another and extending across each of the respective top and bottom surfaces of the base 24. In such an embodiment, as at FIG. 11, either the top or bottom surface can be positioned into confronting relation to the child, which provides for some measure of convenience, as the orientation of top surface vs. the bottom surface does not present a functional concern. It is also within the scope and intent of the present invention that in an alternative embodiment, only one surface, namely, the "top" surface, comprises a relief configuration, the top surface being disposed in confronting relation to the child.

Further, the cover 26 may additionally comprise a fluid permeable construction such that the cover 26 and the base 24 can be cooperatively structured to allow fluids to pass through the cover 26 and into the channels 25, as at FIG. 11. For instance, in one embodiment, air is permitted to circulate between the cover 26 and the channels 25, thus providing an additional degree of ventilation for the child's comfort. In addition, the fluid permeable cover 26 can be further structured to permit liquids to pass there through into one or more of the channels 25, such as in the case of a drink that has been spilled onto the base 24 by the child so as to not pool on the surface or be substantially absorbed by the cover 26. Further still, the aforementioned air circulation facilitates drying of the cover 26, in the event that any residual amount of liquid has been retained by the cover 26, itself. Although the fluid permeable cover 26 may comprise a variety of materials and/or other structural features, in at least one preferred embodiment, the cover 26 comprises a fabric or textile construction, such as a cotton sheet.

Figure 12:
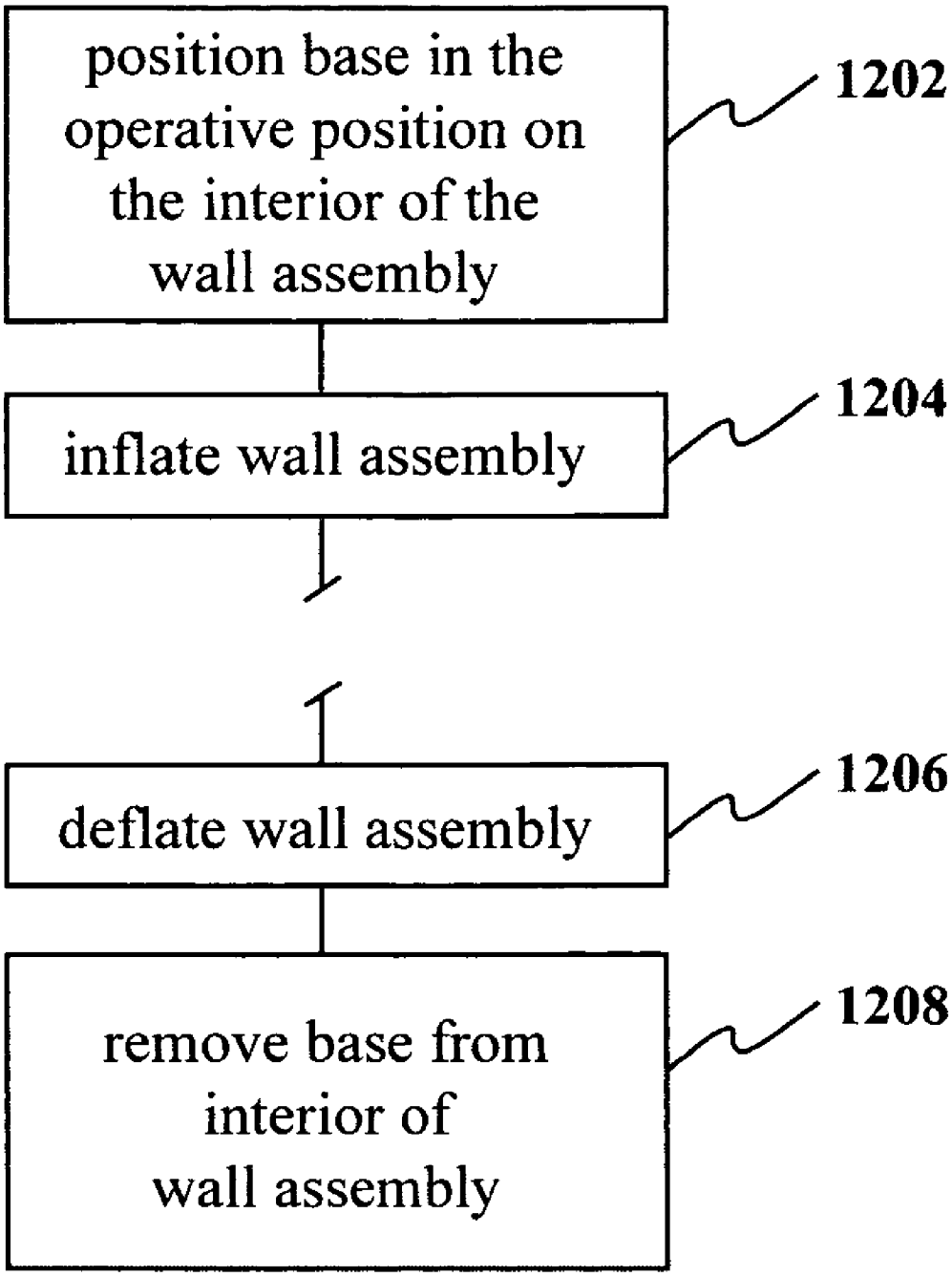
FIG. 12 is a flowchart of a method for inflating the child containment assembly according to the present invention.

Referring again to FIGS. 9 and 10, as well as to FIG. 12, the present invention additionally includes a method for assembling and disassembling the child containment assembly 10.

Specifically, the inventive method comprises a "two-step" process wherein the proper operative engagement between the base 24 and the wall assembly 12 is contingent upon the order in which the aforementioned components are assembled as well as the order in which the wall assembly 12 is inflated. This method ensures that the base 24 must be properly positioned before the wall assembly 12 is inflated. As mentioned above, when temporarily locked into its operative position as represented in FIGS. 2 and 10, the base 24 completely overlies and covers the interior surface 16' of the closure assembly 16. This should prevent a hand or foot or the hands, feet or other portions of the child's body from passing between the periphery 24' of the base 24 and the correspondingly disposed interior surface of the wall assembly 12.

Accordingly, and with reference now to the flow chart of FIG. 12, the method begins with positioning the base 24 in an operative position on the interior of the wall assembly 12, as at Block 1202. Specifically, the base 24 is disposed in an overlying relation to the interior surface 16' of the closure assembly 16. Next, the wall assembly 12 is inflated, as at 1204, which temporarily locks the base 24 into its operative position as represented in FIGS. 2 and 10. As described above, and also as shown in FIG. 10, when both the base 24 and the wall assembly are inflated, the child containment assembly 10 is structured to prevent the child or infant from getting an appendage lodged in-between the periphery 24' of base 24 and the interior surface of the of the wall assembly 12.

Moreover, and as shown in FIG. 9, if the wall assembly 12 is inflated without the base 24 being disposed in its operative position, the interior of the wall assembly 12 is dimensioned such that the base 24 cannot thereafter be properly placed or seated into the interior of the wall assembly 12. This serves to deter improper or potentially hazardous use of the base 24.

It is further noted that the base 24 may be inflated either before or after being placed into its operative position, so long as the base 24 is placed into its operative position before inflation of the wall assembly 12. However, in one embodiment, it is preferable to inflate the base 24 before inflating the wall assembly 12.

Once the base 24 is properly disposed in the operative position and the wall assembly is inflated to the expanded orientation, the base 24 can only be removed by reversing the inflation process, namely, the wall assembly 12 must be substantially deflated before the base 24 can be disengaged from the operative position. Thus, to continue with the method of FIG. 12, the wall assembly 12 is substantially deflated, as at 1206. Thereafter, the base 24 is removed from the interior of the wall assembly 12, as at 1208.

With reference again to FIGS. 4-6, the containment assembly 10 when in the upright or first operative position may also be used as a contained play area or space and as such may be more descriptively referred to as a "play yard." As also represented therein, the containment assembly 10 can be used in an indoor or outdoor environment and may be positioned in accessible relation to a variety of other accessories such as an outdoor umbrella 29 supporting chair 31 for a caregiver or parent, or other structures. Further, when used as the aforementioned contained play yard, the child containment assembly 10 may be used with or without the inflated, removably disposed base 24. Therefore, when the base 24 is not used, the interior surface 16' of the closure assembly 16 serves as a supportive floor, wherein the closure assembly 16 is disposed in confronting relation to or immediately adjacent a supporting surface of the child containment assembly 10, such as a ground surface, flooring, etc.

With primary reference to FIG. 3, the versatility of the child containment assembly 10 is further demonstrated by allowing it to be selectively disposed in an inverted, second operative position as generally described above. When in such an inverted or second operative position, the exterior surface of the closure assembly 16, as at 16" is exposed and the strength and fixed interconnection of the closure assembly 16 to the corresponding end 12' of the wall assembly 12 is sufficient to allow the closure assembly 16 to serve as a support platform. The support platform defined by the closure assembly 16 allows the exposed surface 16" to serve as a dressing or changing area or other supportive surface structure to manipulate or otherwise perform various procedures or functions on an infant resting on the closure assembly 16. Further, the high strength and flexible nature of the closure assembly 16 allows it to assume somewhat of a "hammock" like configuration. As such, a supported infant is thereby at least minimally cradled thereby reducing the possibility of the infant inadvertently falling from the support platform or outer surface 16" of the closure assembly 16.

Therefore, it should be apparent that the structural and operative features of the containment assembly 10 include the inflated construction thereof having a sufficient "structural integrity" to facilitate it being used for a variety of different applications, whether in the upright, first operative position of FIG. 1 or the inverted, second operative position of FIG. 3. Such structural integrity is at least partially accomplished by the structuring of each of the plurality of wall sections 14 to have somewhat of an "I-beam" structure which will be demonstrated with regard to FIGS. 1, 3 and 4. More specifically each of the wall sections 14 includes a surrounding, inflatable peripheral portion 32 disposed in surrounding relation to a window segment generally indicated as 34. The window segment 34 of at least one but more preferably each of the plurality of wall sections 14 comprises at least one panel or sheet formed of an air permeable material such as an open mesh or screen like material. As such, proper ventilation of the containment area 15 is accomplished by allowing air flow through each of the one or more window segments 34. In one particular embodiment, the window segments 34 each comprise two panels 39 disposed in spaced relation transversely within the wall section 14, as referenced in FIG. 13. More specifically, a first panel 39 is disposed proximate to the exterior surface of the wall assembly 12, and a second panel 39 is disposed proximate to the interior surface of the wall assembly 12. When two or more panels 39 are so arranged for each window segment 34, the plurality of panels 39 provides an additional measure of structural protection relative to that afforded by a single panel 39.

Further, the aforementioned I-beam construction, which at least in part provides the structural integrity for the containment assembly 10 and in particular the wall assembly 12, is defined by adjacent peripheral portions 35 of each adjacently disposed wall section 14 being fixedly interconnected continuously between opposite ends of the wall section 12, such as between the access opening 18 and the opposite end 12'. While fixedly connected, these elongated peripheral, inflatable portions 35 are each connected at opposite ends thereof to transverse or end bordering portions 37. As such, the opposite transverse inflatable peripheral portions 37 define the ends of the aforementioned I-beam construction wherein the elongated intermediate portions 35 define the interconnecting portions of the aforementioned I-beam construction.

Each of the adjacently positioned and interconnected wall sections 14 are so formed thereby providing a significant and sufficient strength or structural integrity to the overall containment assembly 10 and in particular the wall assembly 12. This allows an infant of predetermined size to be adequately but safely contained within the containment area 15 and even allows the infant to rest on and be at least partially supported by the various wall sections 14 as clearly demonstrated in FIGS. 4 and 5. Further, the structural integrity defined by the aforementioned I-beam construction also allows sufficient strength to allow the containment assembly 10 and in particular the wall assembly 12 to adequately support an infant or child on the closure assembly 16 when it serves as a support platform for a changing or dressing area, as at 16". In addition, in the event that one or more of the wall sections 14 becomes at least partially deflated during use, the structural integrity provided by the I-beam construction will allow the wall assembly 12 to maintain a substantially upright position so as to prevent collapsing or "folding in" of the wall assembly 12 onto the children who have been placed in the containment area 15.

Figure 13:
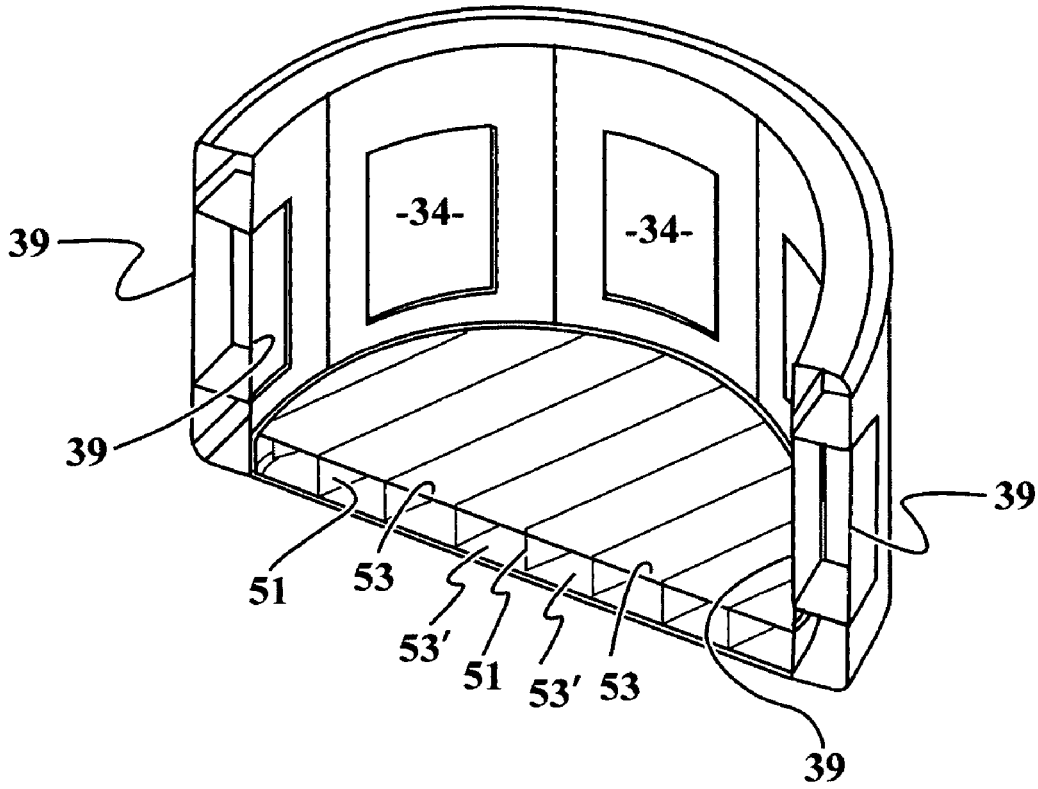
FIG. 13 is a partial perspective view of yet another embodiment of a child containment assembly.

With reference now to FIG. 13, the base 24 may also comprise an "I-beam" type configuration for additional structural integrity. In this embodiment, the base 24 comprises a plurality of ribs 51 disposed in spaced relation to one another. The ribs 51 are further disposed in supporting relation between opposite top and bottom surfaces of the base 24. The "I-beam" structure is thus defined by adjacent portions 53, 53' of the respective surfaces of the base 24 connected to each corresponding edge of the ribs 51. To facilitate inflation, the plurality of ribs 51 is also configured to permit fluid communication between the interior sections of the base 24 which are formed by the ribs 51.

Other features and/or structural modifications of one or more preferred embodiments of the child containment assembly 10 include the interior surface 16' of the closure assembly 16, at least when serving as a floor for a splash pool or the like, having an embossed or otherwise roughened surface configuration to reduce the possibility of inadvertent slippage or falling when water is contained within the containment area 15. Also, one or a plurality of handles as at 38 are connected to and disposed in spaced relation about the outer surface of the wall assembly 12 as represented in FIG. 1. These one or more handles 38 are disposed and structured to facilitate movement of the containment assembly 10 over any type of supporting surface whether it is disposed in an indoor or outdoor environment.

Figure 2A:
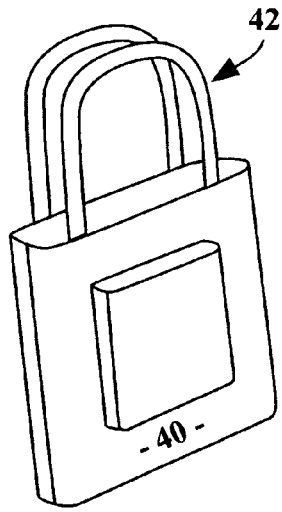
FIG. 2A is a perspective view of an individual and a carrying or storing container dimensioned and structured to carry all of the operative components of the embodiment of FIG. 1 when the components are in a deflated, collapsed orientation.

With reference to FIG. 2A, one additional embodiment of the child containment assembly 10 comprises a kit assembly. As such, a user supports a bag, pouch or other appropriate container 40, which is dimensioned and configured to store and contain for transport each of the plurality of inflatable and therefore collapsible components including, but not limited to, the wall assembly 12 and the base 24. Also, an inflating structure such as a manual or powered air or fluid pump may be of sufficient size to be contained within the pouch or carrier bag 40. As further demonstrated in FIGS. 1 and 2A, the carrier bag or pouch 40 may also include a handle or shoulder sling as at 42 which facilitates it being supported on the shoulder or otherwise being gripped or carried on an individual user.

Figure 15:
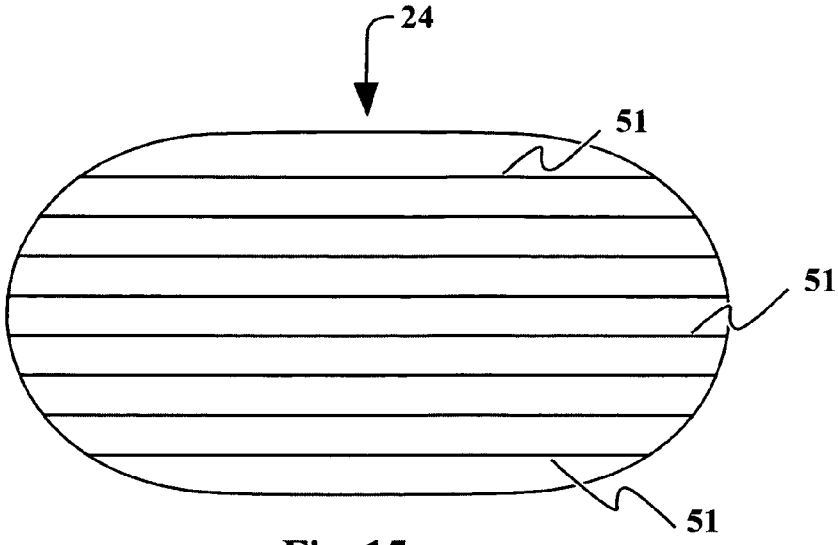
FIG. 15 is an elevation view of the base of the embodiment of FIG. 14.

Although the above described embodiments are generally directed to a substantially annular configuration of the child containment assembly 10, it is within the scope and intent of the present invention that a variety of other shapes and/or configurations may be utilized as well, including, but not limited to, rectangular configurations, polygonal configurations, or irregular shapes. For example, in the embodiment of FIGS. 14 and 15, discussed in more detail below, the child containment assembly 10 comprises an oblong configuration.

Further, the dimensions of the child containment assembly 10 can substantially vary as well, depending on a variety of factors including the size and number of the particular children or infants for which the assembly 10 is being used. For example, the height of the wall assembly 12 will typically range from approximately twelve to thirty six inches (12"-36"), although other heights may also be suitable. Likewise, the primary outer dimensions of the wall assembly 12 will typically range from about thirty eight to forty four inches (38"-44"), although they may range from as small as approximately one foot (1') to upwards of twelve feet (12') or more, depending on the targeted use. The primary dimensions of the base 24, as well as those of the interior of the wall assembly 12, will range accordingly. The thickness or transverse dimension of the base 24 will typically range from about two to four inches (2"-4"), although other suitable thicknesses may be utilized as well.

Referring now to yet another possible use, the containment assembly 10 may be utilized as a wash basin for bathing a child, as depicted in FIG. 14. In this embodiment, the window segments 34 are disposed a sufficient distance from the interior surface 16' of the closure assembly 16 to ensure that a sufficient quantity of water for bathing the child can be maintained within the containment area 15. Moreover, the strategic positioning of the window segments 34 minimizes the potential for the bath water to exit the interior containment area 15 through the window segments 34 due to spilling, splashing, etc. Further, the base 24 can additionally include an embossed or otherwise roughened surface configuration to reduce the possibility of inadvertent slippage.

Another feature associated with the wash basin use is the provision of a marker line 19 or some other type of visual indicator which provides a reading as to the maximum "safe" quantity of water which should be maintained within the containment area 15. Such a quantity of water preferably, but not necessarily, provides a depth of approximately one to two inches (1"-2") in covering relation above the top surface of the base 24 when the base 24 is disposed in an operative position.

Figure 16:
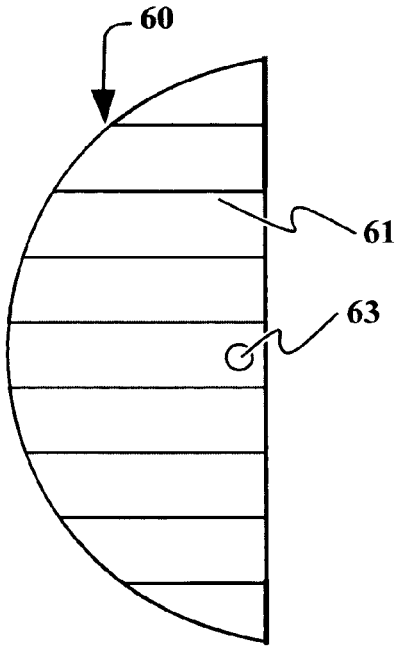
FIG. 16 is a top elevation view of one embodiment of a head support in accordance with the present invention.
Figure 16A:
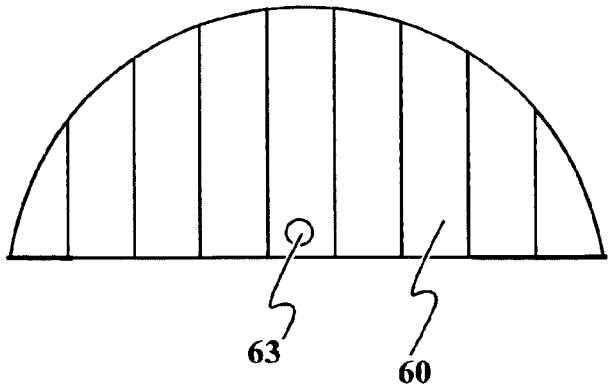
FIG. 16A is a top perspective view of another embodiment of a head support in accordance with the present invention.
Figure 17:
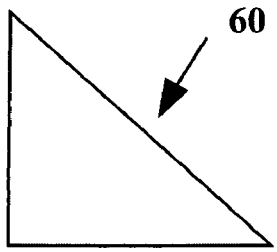
FIG. 17 is a side elevation view of the head support of FIG. 16.

Turning now to FIGS. 16-19B, the child containment assembly further comprises a head support 60 which is dimensioned and configured to substantially correspond to, and be disposed in abutting relation to, at least a portion of the interior surface of the wall assembly 12 immediately adjacent to the operatively positioned base 24. For example, the head support 60 of FIGS. 16 and 16A is specifically configured to be utilized with the oblong configuration of the embodiment of FIGS. 14, 18-19B. The head support 60 is also structured to be inflated, and has a sufficient thickness as well as a sufficient fluid capacity to support a child's head. In at least one embodiment, the head support 60 comprises a wedge shaped configuration, as depicted in FIG. 17. Further, a retractable inflation valve 63 may be utilized for comfort so as to avoid uncomfortable contact with the child's resting head, and the valve 63 may additionally comprise a one-way check valve configuration for added safety. The head support 60 may also comprise a plurality of ribs 61. As depicted in FIG. 16, the ribs 61 are disposed in spaced relation to one another and are structured to further support the child's head. To facilitate inflation, the plurality of ribs 61 is also configured to permit fluid communication between the interior sections of the head support 60 which are formed by the ribs 61.

Figure 18:
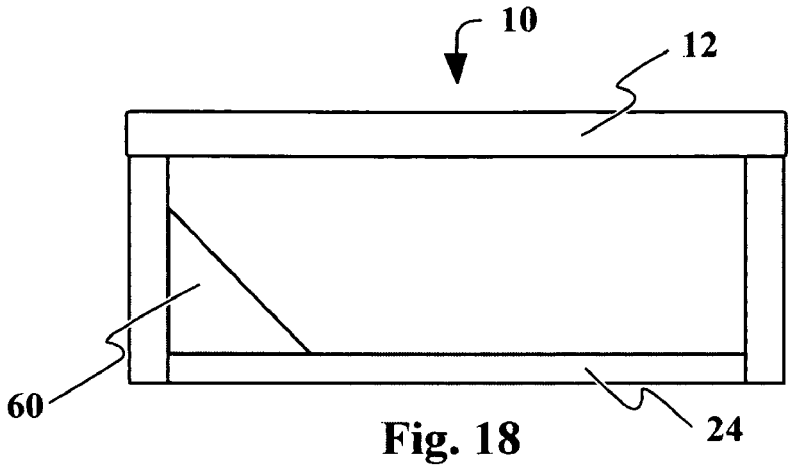
FIG. 18 is schematic cross sectional view of the head support of FIG. 16 disposed in an operative position.
Figure 18A:
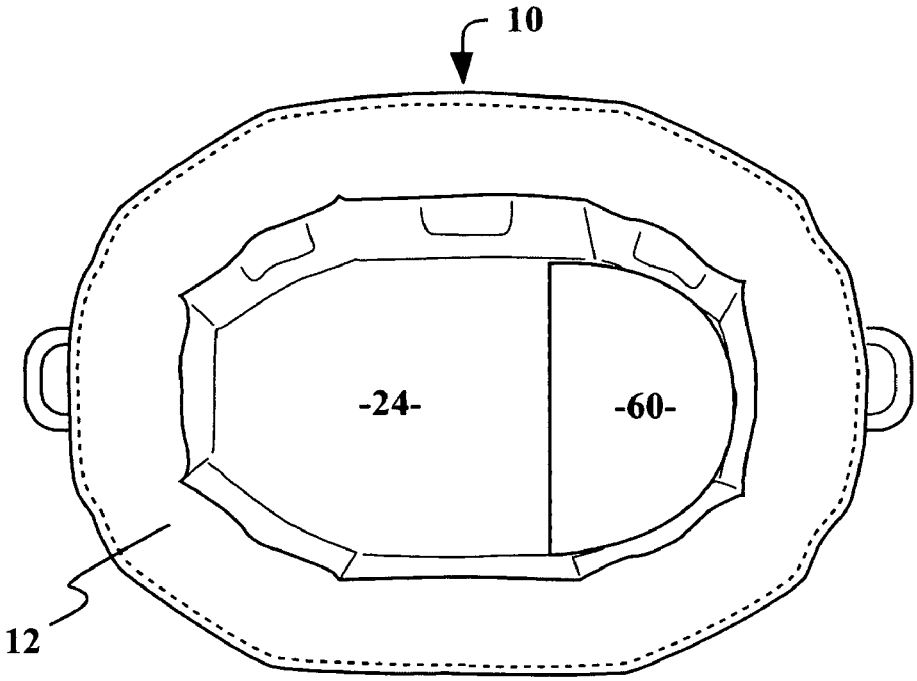
FIG. 18A is a top perspective view of the head support of FIG. 16*a* disposed in an operative position.
Figure 19:
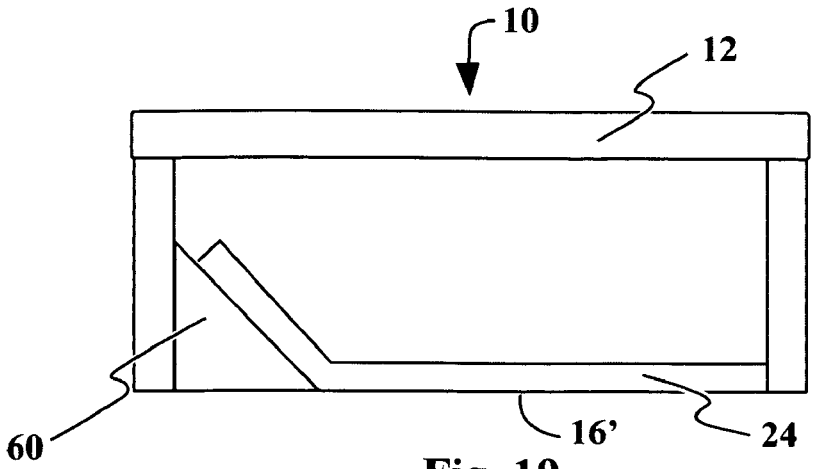
FIG. 19 is schematic cross sectional view of the head support of FIG. 16 disposed in an operative position upon an interior surface of a closure assembly.
Figure 19A:
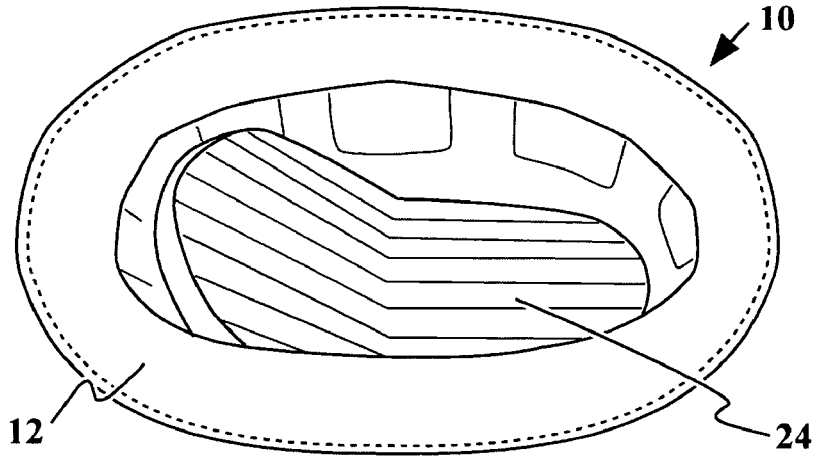
FIG. 19A is a perspective view of the head support of FIG. 16*a* disposed in supporting relation to a base.
Figure 19B:
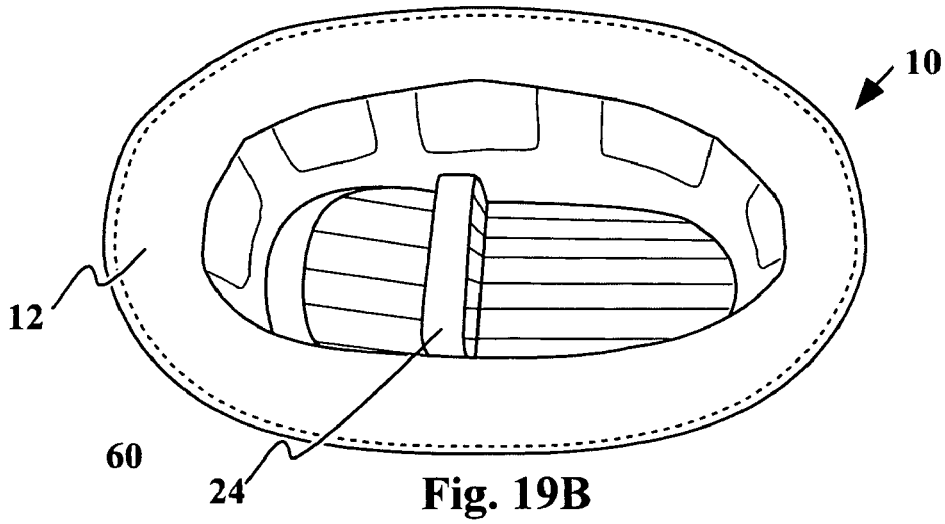
FIG. 19B is a perspective view of embodiment of FIG. 19A showing the position of the head support in relation to the position of the base.

The head support 60 is further structured to be cooperatively utilized with the base 24 as seen in FIGS. 18-19B, particularly when the child containment assembly 10 is used as a wash basin or feeding area. Accordingly, the head support 60 may be cooperatively utilized with the base in a variety of suitable configurations. For instance, in one configuration, the head support 60 can be disposed in overlying, supported relation to the top surface of the base 24, as depicted in FIGS. 18 and 18A. In this configuration, a periphery 60' of the head support 60 may also establish a snug, frictional but removable engagement with the corresponding interior surface portions of the wall assembly 12. In another configuration, the head support 60 can be disposed in supporting relation to at least a portion of the base 24, as illustrated in FIGS. 19-19B. In this configuration, the base 24 may be partially deflated so as to more easily conform to the positioned head support 60.

Figure 20:
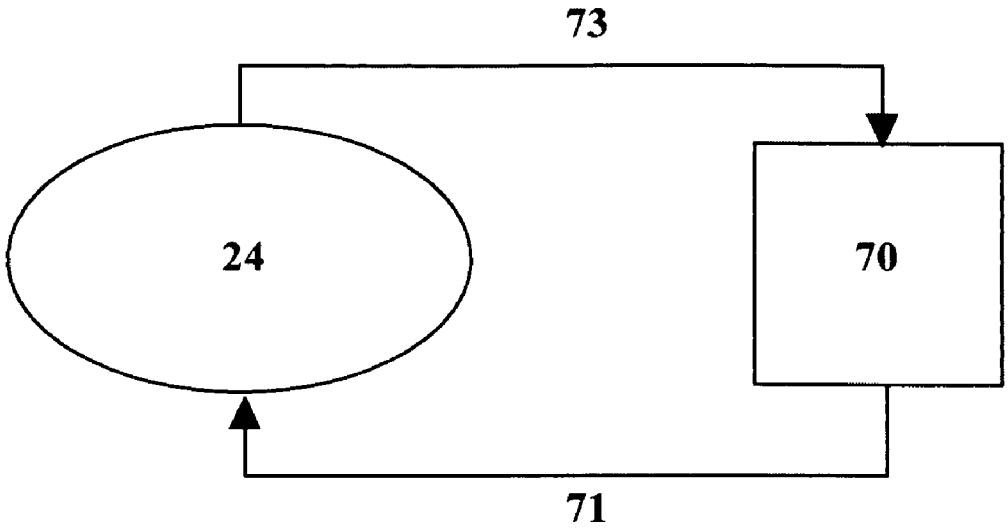
FIG. 20 is a schematic diagram of a temperature control capability involving a base and a regulator.

With reference now to FIG. 20, another inventive feature of the child containment assembly 10 involves a temperature control capability. In particular, the temperature control capability can be utilized to heat or cool at least a portion of the child containment assembly 10 to provide a desired temperature environment for the child. As illustrated in the schematic representation of FIG. 20, in one embodiment, the temperature of the base 24 is controlled by the temperature of the air or other type of fluid that is utilized to inflate the base 24, including but not limited to liquids, such as water. Specifically, the base 24 is disposed in circulating fluid communication with a regulator 70, wherein the regulator 70 is structured to maintain a predetermined temperature, as well as a corresponding predetermined inflation pressure, of the air. The regulator 70 circulates the air by sending a first quantity of air at an appropriate temperature and pressure to the base 24, as at 71. It turn, the regulator 70 receives a second quantity of air from the base 24, as at 73. The air is thus circulated as necessary to maintain a predetermined temperature of the base 24. Although the embodiment of FIG. 20 depicts temperature control of the base 24, the temperature of other components of the child containment assembly 10, such as the wall assembly 12 or the head support 60, may also be regulated in a similar manner.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described:

What is claimed is:

1. A containment assembly for a child structured for multiple uses, said containment assembly comprising:

a wall assembly having an inflatable construction and disposable in an expanded orientation and a collapsed orientation, said wall assembly comprising a closed, continuous configuration disposed in surrounding relation to a containment area when in said expanded orientation, said wall assembly further comprising a plurality of wall sections successively interconnected and collectively disposed to define said closed, continuous configuration, at least one of said wall sections comprising a window segment at least partially formed of an air permeable material and disposed and dimensioned to facilitate ventilation of said containment area, said window segment comprising at least two air permeable panels transversely spaced within said wall section, with an inflatable portion of said wall section extending about a periphery of said window segment in at least partially surrounding relation thereto, a closure assembly connected in covering relation to one end of said wall assembly and in closing relation to a corresponding end of said containment area, said wall assembly comprising an access opening oppositely disposed to said closure assembly and dimensioned to allow passage of a child there through into and out of said containment area, said wall assembly having a sufficient structural integrity when in said expanded orientation to be selectively disposed in either a first operative position or a second operative position, said first operative position at least partially defined by said closure assembly disposed in adjacent relation to a supporting surface of the containment assembly, said second operative position at least partially defined by said closure assembly being disposed at an upper end of said wall assembly, with said access opening being disposed adjacent the supporting surface of the containment assembly in an inverted orientation relative to the first operative position, and wherein said closure assembly is disposed and cooperatively structured with said wall assembly to define a support platform for a child, when said wall assembly is in said second operative position, and a base removably disposed within said containment area and dimensioned and configured to correspond to an interior surface portion of said containment area adjacent said closure assembly, said base further comprising a sufficient corresponding peripheral dimension relative to a correspondingly disposed interior surface of said wall assembly to frictionally and removably engage said interior surface of said wall assembly.

2. A containment assembly as recited in claim 1 wherein at least one primary surface of said base is structured to define a surface relief configuration.

3. A containment assembly as recited in claim 2 wherein said surface relief configuration comprises a plurality of v-shaped channels disposed in spaced relation and extending across said at least one primary surface.

4. A containment assembly as recited in claim 3 further comprising a fluid permeable cover removably disposed in at least a partially surrounding relation to said base and cooperatively structured with said v-shaped channels to allow fluids to pass through said cover and into said v-shaped channels.

5. A containment assembly as recited in claim 1 wherein said closure assembly comprises a flexible material sheet.

6. A containment assembly as recited in claim 1 wherein said closure assembly comprises a flexible material panel connected continuously about a periphery thereof in substantially fluid sealing engagement to said wall assembly.

7. A containment assembly as recited in claim 6 wherein said wall assembly and said closure are cooperatively structured to maintain a sufficient quantity of water within said containment area to at least cover an interior surface of said closure assembly, when said wall assembly is in said first operative position.

8. A containment assembly as recited in claim 1 further comprising an inflatable head support dimensioned and configured to substantially correspond to at least a portion of the interior surface of the wall assembly immediately adjacent to the base.

9. A containment assembly as recited in claim 8 wherein said inflatable head support further comprises a wedge shaped configuration.

10. A containment assembly as recited in claim 1 wherein said window segment is at least partially formed of an open mesh material.

11. A containment assembly as recited in claim 1 wherein said base comprises an at least partially inflatable construction structured to lock into position when substantially inflated.

12. A containment assembly as recited in claim 11 wherein said base comprises a transverse dimension and a fluid capacity sufficient to define a cushion removably disposable in overlying, covering relation to an interior surface of said closure assembly.

13. A containment assembly as recited in claim 1 wherein at least the majority of said plurality of wall sections each comprise a window segment at least partially formed of an air permeable material, each of said window segments of each of said wall sections disposed and dimensioned to facilitate ventilation of said containment area.

14. A containment assembly as recited in claim 13 wherein each of said window segments comprises at least two flexible, open mesh material panels.

15. A containment assembly as recited in claim 14 wherein at least one of said window segments comprises a plurality of panels disposed in spaced relation transversely within said wall section.

16. A containment assembly as recited in claim 13 wherein each of said majority of wall sections further comprises an inflatable portion extending about a periphery of a corresponding one of said window segments in at least partially surrounding relation thereto.

17. A containment assembly as recited in claim 16 wherein said inflatable portion of each of said majority of wall sections is connected to said periphery of said window segment in continuously surrounding relation thereto.

18. A containment assembly as recited in claim 17 wherein said inflatable portions of adjacent ones of said plurality of wall sections are continuously connected to one another between opposite ends of said wall assembly so as to at least partially define an I-beam construction of a portion of said wall assembly disposed between each of said window segments.

19. A containment assembly as recited in claim 18 wherein said window segments of adjacent ones of said wall sections are disposed in spaced relation to one another.

20. A containment assembly as recited in claim 1 wherein said inflatable portion is connected to said periphery of said window segment in continuously surrounding relation to said window segment.

* * * * *